United States Patent [19]

Fanella

[11] 4,133,486

[45] Jan. 9, 1979

[54] HAIR SPRAY ASSEMBLY

[76] Inventor: Michael R. Fanella, 2111 Kenicott, Arlington Heights, Ill. 60004

[21] Appl. No.: 846,336

[22] Filed: Oct. 28, 1977

[51] Int. Cl.[2] ..... B05B 1/28

[52] U.S. Cl. ..... 239/499; 239/519

[58] Field of Search ..... 239/288.5, 499, 518, 239/519, 602

[56] References Cited

U.S. PATENT DOCUMENTS

| | | | |
|---|---|---|---|
| 722,849 | 3/1903 | Kesselring | 239/288.5 |
| 1,895,307 | 1/1933 | Beck | 239/499 |
| 2,136,050 | 11/1938 | Holden | 239/288.5 |
| 3,342,419 | 9/1967 | Weese | 239/602 X |
| 3,348,777 | 10/1967 | Hjulian | 239/602 X |

*Primary Examiner*—Robert W. Saifer
*Attorney, Agent, or Firm*—Dressler, Goldsmith, Clement, Gordon & Shore, Ltd.

[57] ABSTRACT

A hair spray assembly is provided to substantially limit and confine the divergence and radial projection of spray emanating from a shower head into a generally cylindrical spray zone and to substantially prevent splashing and dripping of the water spray outside of that spray zone. This invention is particularly useful for professional hair care and treatment, such as permanent waving, frosting of the hair and shampooing and structurally includes a portable nozzle having a body with a diverging mouth that defines an outlet and a tubular inlet that telescopes into a flexible hose. A shower head having an annular flange is secured to the body of the nozzle and includes an apertured disc that covers the mouth of the nozzle and a rigid rim portion that extends axially forwardly of the apertured disc. A waterproof annular skirt engages the shower head and includes a lip portion that extends axially forwardly of the rigid rim portion. Desirably, the lip portion is resilient and substantially more flexible than the rigid rim portion.

11 Claims, 5 Drawing Figures

FIG. 1
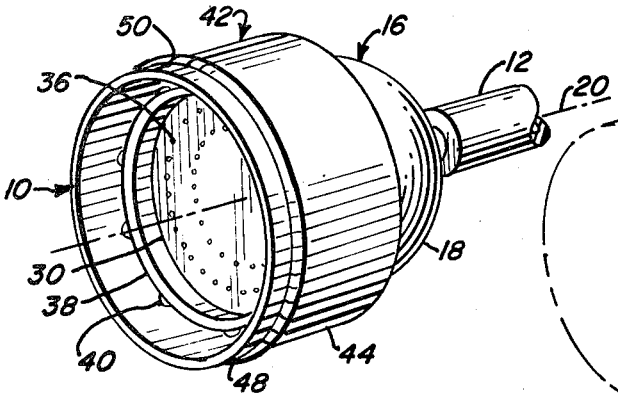
FIG. 2
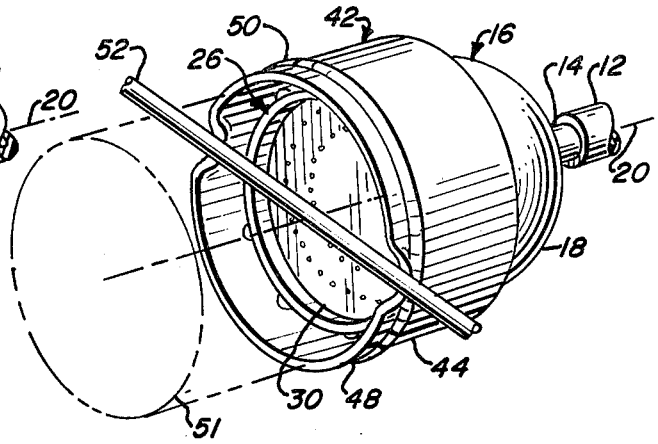
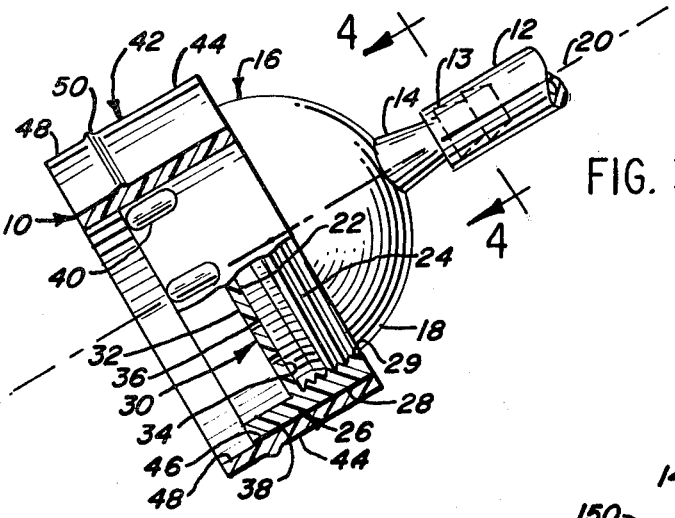
FIG. 3
FIG. 5
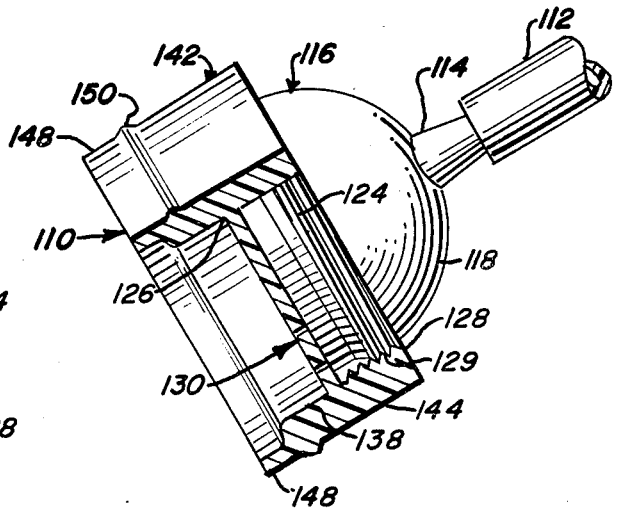
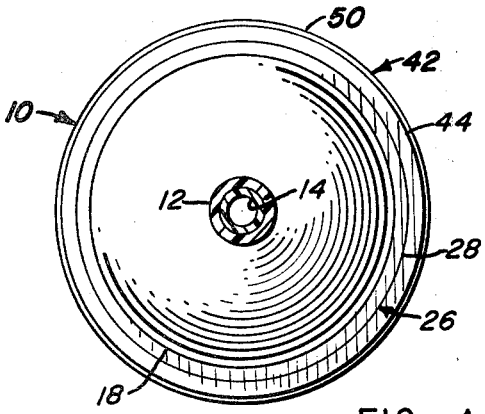
FIG. 4

HAIR SPRAY ASSEMBLY

BACKGROUND OF THE INVENTION

This invention relates to a shower head, and, more particularly, to a portable shower head for use in professional hair treatment.

The rigid structure of conventional shower heads typically do not provide an effective seal for use in professional hair treatment. Consequently, when these conventional shower heads are placed against a frosting cap during frosting of the hair, leakage gaps often appear between the shower head and the frosting cap which undesirably permits the spray to leak down the cap onto the customer.

When these conventional shower heads are placed against permanent wave rods during permanent waving, leakage gaps often appear between the shower head and the permanent wave rod which undesirably causes dripping and leakage of the spray down the permanent wave rod. Furthermore, conventional shower heads typically allow unrestrained splashing of the spray off the permanent wave rod.

When rigid conventional shower heads are placed upon the hair of a customer during shampooing, similar leakage of the spray often occurs. Moreover, the rigidity and hardness of these conventional rigid shampoo heads may be abrasive and uncomfortable to the scalps of some customers.

Another problem for professional beauticians and stylists is that prior art shower heads typically do not adequately concentrate the water spray and confine the spray within a generally cylindrical zone immediately adjacent the shower head, but instead, allow the spray to diverge into a conical unrestrained spray.

It is therefore desirable to construct a shower head which overcomes most, if not all, of the above disadvantages.

SUMMARY OF THE INVENTION

An improved hair spray assembly is provided which is particularly adapted for permanent waving, shampooing and frosting of the hair. The novel hair spray assembly advantageously confines the spray to a cylindrical zone immediately adjacent the front of the shower head and desirably prevents most leakage and dripping of the spray outside of that cylindrical zone.

The hair spray assembly includes a flexible hose and a portable nozzle having a tubular inlet which is telescopically coupled to the flexible hose. The portable nozzle includes a body with a diverging mouth that defines an outlet communicating with the tubular inlet.

A shower head having an annular flange is adapted to be secured to the body of the nozzle and includes a disc extending from the annual flange to substantially cover the mouth of the nozzle. The disc has a front face, a back face which is positioned adjacent the annular flange, and defines an array of fluid flow apertures which communicate with the nozzle. The shower head further includes an arcuate rigid rim portion, preferably taking the form of a rigid rim which circumscribes the disc and extends axially forwardly of the front face.

An annular skirt is positioned adjacent and engages the shower head. The annular skirt includes a lip portion that extends axially forwardly of the rigid rim portion. The lip portion is resilient and substantially more flexible than the rigid rim portion to permit the hair spray assembly to matingly engage and sealingly conform to the shape of a customer's hair, as well as to the contours of portions of a permanent wave rod and a frosting cap. The annular skirt also includes an engaging portion that preferably circumscribes and is secured to the annular flange.

In one embodiment, an adhesive is provided to fixedly bond the engaging portion to the annular flange. In another embodiment the engaging portion of the skirt is integrally molded to the flange.

Desirably, the annular skirt includes a raised gripping surface, such as circular ribs, diamond-shaped matrices, axial ridges or an array of hills and valleys, to accommodate manual gripping of the lip portion.

In the preferred embodiment, the annular skirt is liquid impervious and desirably takes the form of a flexible plastic or rubber-like band having an axial length greater than the axial length of the shower head. Furthermore, the annular skirt is preferably of a thickness for readily permitting axial resilient deformation of the lip portion.

A more detailed explanation of the invention is provided in the following description and appended claims taken in conjunction with the accompanying drawings.

BRIEF DESCRIPTION OF THE DRAWINGS

FIG. 1 is a perspective view of a hair spray assembly in accordance with principles of the present invention;

FIG. 2 illustrates the hair spray assembly in sealing engagement with a permanent wave rod during permanent waving;

FIG. 3 is a side view of the hair spray assembly with portions illustrated in cross-section;

FIG. 4 is a rearward view of the hair spray assembly taken substantially along line 4—4 of FIG. 3; and FIG. 5 is another embodiment of the hair spray assembly with some portions shown in cross-section.

DETAILED DESCRIPTION OF THE ILLUSTRATIVE EMBODIMENT

The hair spray assembly 10 illustrated in FIGS. 1–4 of the drawings is particularly useful in professional hair treatment and care, such as for shampooing, permanent waving and frosting of the hair. While the inventive hair spray assembly is most useful by professional beauticians and hair stylists in commercial establishments, the inventive hair spray assembly is also advantageous for non-professionals in non-commercial establishments, such as the home.

The component parts of the hair spray assembly 10 include a flexible hose or tubular conduit 12 made of plastic or rubber. One end of hose 10 is typically connected to the nozzle or faucet of a shampoo bowl or sink (not shown) and the other end of the hose 12 is typically telescopically coupled and connected to the external surfaces of a saw-tooth type nipple 13 (FIG. 3) of a rearwardly tapered tubular inlet 14 of a light-weight portable nozzle 16.

The portable nozzle 16 desirably has a diverging or outwardly flared body 18. In the illustrative embodiment, body 18 is hemispherical or bowl-shaped and axially aligned with and converging toward the tubular inlet 14 so as to lie on a common longitudinal axis 20 with the tubular inlet 14. Body 18 also has a diverging mouth 22 (FIG. 3), that is axially opposed from the tubular inlet 14, and defines a fluid-flow outlet. In the preferred embodiment, there are external threads 24 (FIG. 3) on the body 18 adjacent the mouth 22.

In order to provide the spray, a shower head 26 (FIG. 3) is provided. The shower head 26 has an annular flange 28, which is preferably circular in cross-section and internally threaded 29 to threadedly engage the external threads 24 of the nozzle 16. In some circumstances it may be desirable to integrally mold the annular flange 28 to the body 18 of the nozzle 16.

The shower head 26 includes a disc 30 that extends perpendicularly inwardly from the internally threaded circular flange 28 to substantially cover the mouth 22 of the nozzle 16. The disc 30 has a front face 32, a back face 34 which is positioned adjacent the internally threaded circular flange 28, and defines an array of fluid flow apertures 36 which communicate with the nozzle 16 so as to discharge or emanate a spray or mist of liquid, such as water droplets. In the illustrative embodiment, the disc 30 is generally planar or flat, but it may be desirable in some circumstances that the disc be curved, either convex or concave.

The shower head also has an arcuate rigid rim portion which preferably takes the form of an annular rigid rim 38, as best shown in FIG. 1, that circumscribes and projects axially and perpendicularly forwardly of the front face 32 (FIG. 3) of the disc 30. In the illustrative embodiment, the shower head 26 has a plurality of axial beads 40 (FIGS. 1 and 3) that are circumferentially and equally spaced from each other, and extend radially outward from the rigid rim 38.

The shower head 26 and the portable nozzle 16 of the illustrative embodiment are preferably made of impact-resistant plastic, but other materials can be used if desired, such as aluminum, stainless steel or other metals.

One of the features of the present invention is the provision of an annular skirt 42, which is waterproof and preferably liquid impervious. The annular skirt 42 is positioned adjacent and is securely engaged to the shower head 26 so as to preferably circumscribe the shower head as shown in FIGS. 2–4. Desirably, the annular skirt includes an engaging portion 44 that intimately contacts and is fixedly secured to the annular flange 28 of the shower head 26, such as by adhesive or glue 46 (FIG. 3) and includes a lip portion 48 that extends axially and integrally from the engaging portion 44 to a position forwardly of the rigid rim 38. In the illustrative embodiment the engaging portion 48 covers the entire outer surface area of the annular flange 28. In some circumstances, however, it may be desirable that the lip portion 48 only cover a portion of the outer surface of the annular flange 28 and/or that the engaging portion intimately contact and be secured only to the rigid rim, either axially or circumferentially.

Preferably, the outer external surface of the lip portion 48 has a raised gripping surface 50, such as one or more circumferential or annular ribs to facilitate manual gripping of the lip portion. Other gripping surfaces, such as axial ridges, diamond-shaped matrices, raised portions, grooves, gripping fingers, or an array of hills and valleys can be used if desired.

In the preferred embodiment, the lip portion 48 is generally concentric and parallel to the rigid rim 38 about the longitudinal axis 20. The specially configured lip portion 48 generally limits and confines the divergence and radial projection of the water spray emanating and being discharged from the shower head 26 into a generally cylindrical spray zone 51 (FIG. 2) immediately adjacent the front face 32 of the shower head 26.

In accordance with principles of the present invention the lip portion 48 is resilient and substantially more flexible than the rigid, relatively hard, rim 38. The resiliency and flexibility of the lip portion 48 permits the annular skirt 42 to matingly engage, seal and conform to the shape of the hair and to the contours of portions of a permanent wave rod 52 (FIG. 2) and a frosting cap. These desired sealing and shape conforming characteristics substantially prevent splashing and dripping of the water spray outside of the cylindrical spray zone 51 so that the spray will not substantially drip down the hair, a permanent wave rod or a frosting cap.

In the illustrative embodiment, the annular skirt 42 is a flexible plastic or rubber-like band having an axial length (in the direction of the longitudinal axis 20) greater than the axial length of the shower head 26 and has a circular cross-sectional configuration. Preferably, the annular skirt 42 is of a thickness for permitting axial resilient deformation of the lip portion.

In one model of this invention, the lip portion 48 extended from about ¼ inch to about ⅜ inch forwardly of the rigid rim 38 so that it had an overall axial length from about ½ inch to about ⅝ inch forwardly of the disc 30. Other dimensional ranges could also be effectively utilized, however, depending on the overall size of the nozzle 16 and shower head 26.

In use, the hair spray assembly 10 can resiliently and effectively engage and seal against a permanent wave rod 52 (FIG. 2) without the presence of any substantial gaps between the lip portion 48 and the permanent wave rod 52 which might otherwise cause leakage and dripping down the permanent wave rod 52. The inventive hair spray assembly 10 further concentrates the water spray and confines the spray to a cylindrical spray zone 51 (FIG. 2) and substantially limits and minimizes any splashing within the cylindrical spray zone 51. The hair spray assembly 10 is also useful for engaging and sealing a frosting cap during frosting, or upon the hair during shampooing, substantially without leakage and undesirable splashing.

The hair spray assembly 110 illustrated in FIG. 5, is substantially identical to the hair spray assembly 10 illustrated in FIGS. 1–4, except that the annular skirt 142 is integrally molded and intimately connected to the shower head 126. For ease of understanding and clarity, similar parts of the hair spray assembly 110 illustrated in FIG. 5 have been numbered similarly to the parts of the hair spray assembly 10 depicted in FIGS. 1–4, except in the 100 series, for example tubular inlet 114, body 118, etc.

Although embodiments of the invention have been shown and described, it is to be understood that the various modifications and substitutions can be made by those skilled in the art without departing from the novel spirit and scope of this invention.

What is claimed is:

1. A hair spray assembly particularly adapted for permanent waving, shampooing and frosting of the hair, comprising:

a flexible hose;

a portable nozzle having a tubular inlet telescopically coupled to said flexible hose and having a body with a diverging mouth defining an outlet communicating with said tubular inlet;

a shower head having an annular flange for securely engaging said body, a disc extending from said flange and covering said outlet, said disc having a front face, a back face adjacent said flange and defining an array of fluid flow apertures communicating with said nozzle for emanating a spray, and an arcuate rigid rim portion at least partly circumscribing and projecting axially forwardly of said front face; and an annular skirt circumscribing said shower head and including an engaging portion intimately contacting and fixedly secured to said flange and a lip portion axially extending from said engaging portion to a position forwardly of said rigid rim portion for generally limiting the divergence and radial projection of said spray emanating from said spray head into a generally cylindrical zone, said lip portion being resilient and substantially more flexible than said rigid rim portion for matingly engaging and sealingly conforming to hair and to the contours of portions of a permanent wave rod and a frosting cap to substantially prevent splashing and dripping of said spray outside of said spray zone.

2. A hair spray assembly in accordance with claim 1 further including means for fixedly bonding said engaging portion to said flange.

3. A hair spray assembly in accordance with claim 1 wherein said engaging portion is integral with said flange.

4. A hair spray assembly in accordance with claim 1 wherein said annular skirt includes gripping means extending radially outwardly from said lip portion for facilitating gripping of said lip portion.

5. A hair spray assembly in accordance with claim 1 wherein said annular skirt is substantially liquid impervious.

6. A hair spray assembly in accordance with claim 5 wherein said annular skirt comprises a flexible plastic band having an axial length greater than the axial length of said shower head.

7. A hair spray assembly in accordance with claim 1 wherein said annular skirt is of a thickness for permitting axial resilient deformation of said lip portion.

8. A hair spray assembly particularly adapted for permanent waving, shampooing and frosting of the hair, comprising:

a flexible hose;

a portable nozzle having a tubular inlet telescopically coupled to said flexible hose and having a body with a diverging mouth defining an outlet communicating with said tubular inlet;

a shower head having an annular flange for securely engaging said body, a disc extending from said flange and covering said outlet, said disc having a front face, a back face adjacent said flange and defining an array of fluid flow apertures communicating with said nozzle for emanating a spray, and an arcuate rigid rim portion at least partly circumscribing and projecting axially forwardly of said front face; and an annular skirt adjacent said shower head and including a lip portion extending axially forwardly from said rigid rim portion for generally limiting the divergence and radial projection of said spray emanating from said spray head into a generally cylindrical zone, said lip portion being resilient and substantially more flexible than said rigid rim portion for matingly engaging and sealingly conforming to hair and to the contours of portions of a permanent wave rod and a frosting cap to substantially prevent splashing and dripping of said spray outside of said spray zone.

9. A hair spray assembly particularly adapted for permanent waving, shampooing and frosting of the hair, comprising:

a flexible hose;

a portable nozzle having a tubular inlet telescopically coupled to said flexible hose and having a hemispherical body axially aligned with and converging towards said tubular inlet, said hemispherical body having a diverging mouth defining an outlet axially opposed from said inlet and having external threads adjacent said mouth;

a shower head having an internally threaded circular flange for threaded engagement with said external threads, a generally planar disc extending perpendicularly from said internally threaded circular flange and covering said mouth, said disc having a front face, a back face adjacent said internally threaded circular flange and defining an array of fluid flow apertures communicating with said nozzle for emanating a spray, a rigid rim circumscribing and projecting generally perpendicularly forwardly of said front face, and a plurality of axial beads extending radially outward from said rigid rim; and an annular liquid-impervious skirt circumscribing said shower head and including an engaging portion intimately contacting and circumferentially bonded to said circular flange, a lip portion extending axially from said engaging portion to a position forwardly of said rigid rim, and gripping means extending radially outwardly from said lip portion for facilitating gripping of said lip portion, said lip portion being generally concentric and parallel to said rigid rim for generally limiting the divergence and radial projection of said spray emanating from said shower head into a generally cylindrical spray zone and said lip portion being resilient and substantially more flexible than said rigid rim for matingly engaging and sealingly conforming to hair and to the contours of portions of a permanent wave rod and a frosting cap for substantially preventing splashing and dripping of said spray outside of said spray zone.

10. A hair spray assembly in accordance with claim 9 wherein said lip portion extends from about $\frac{1}{4}$ inch to about $\frac{3}{8}$ inch forwardly of said rigid rim.

11. A hair spray assembly in accordance with claim 9 wherein said lip portion extends from about $\frac{1}{2}$ inch to about $\frac{5}{8}$ inch axially beyond said disc.

* * * * *